United States Patent [19]

Reyes

[11] 4,205,939

[45] Jun. 3, 1980

[54] APPARATUS FOR REMOTELY REPAIRING TUBES IN A STEAM GENERATOR

[75] Inventor: Renato D. Reyes, Monroeville, Pa.

[73] Assignee: Westinghouse Electric Corp., Pittsburgh, Pa.

[21] Appl. No.: 873,292

[22] Filed: Jan. 30, 1978

[51] Int. Cl.[2] ..... B65Q 47/90

[52] U.S. Cl. ..... 414/728; 29/402.01; 165/76; 165/11 A; 414/744 R; 414/749; 414/743

[58] Field of Search ..... 165/76; 214/1 B, 1 BB, 214/1 BT, 1 BC, 1 BH, 1 BD, 1 BV, 147 T, 146.5, 1 H, 1 SW, 130 A, 140, 149, 151; 29/401; 414/728, 744, 749

[56] References Cited

U.S. PATENT DOCUMENTS

| | | | |
|---|---|---|---|
| 3,236,397 | 2/1966 | Larin | 214/1 H |
| 3,740,820 | 6/1973 | Tarves, Jr. | 29/401 |
| 3,913,752 | 10/1975 | Ward et al. | 214/1 BB |
| 3,934,731 | 1/1976 | Müller et al. | 214/1 BB |

FOREIGN PATENT DOCUMENTS

| | | | |
|---|---|---|---|
| 965727 | 4/1975 | Canada | 214/1 H |

*Primary Examiner*—Frank E. Werner
*Attorney, Agent, or Firm*—F. J. Baehr, Jr.

[57] ABSTRACT

Apparatus that is assembled quickly inside a channel head of a steam generator and is capable of performing various repair and inspection operations remotely within the channel head for reducing radiation exposure to personnel and facilitate rapid repair of the tubes of the steam generator.

10 Claims, 3 Drawing Figures

APPARATUS FOR REMOTELY REPAIRING TUBES IN A STEAM GENERATOR

BACKGROUND OF THE INVENTION

This invention relates to nuclear steam generators and more particularly to apparatus for remotely repairing the tubes in the nuclear steam generator.

In pressurized water nuclear reactors primary fluid or coolant is pumped through a reactor and a steam generator, radioactive contaminants in the primary fluid are deposited on the tubes and in the channel head of the steam generator so that repair crews are subjected to significant radioactivity when working within the channel head. Therefore, in order to reduce the exposure of personnel to radiation, it is desirable to provide an apparatus which can be remotely operated, can effectively inspect, and can repair the tubes within the steam generator.

In general, apparatus for remotely repairing tubes disposed in a tube sheet in a channel head of a steam generator having a manway disposed in the head, when made in accordance with this invention, comprises a column rotatably disposed in the head generally perpendicular to the tube sheet, a boom pivotally mounted on the column, and means for rotating the column and the boom therewith. The apparatus also comprises means for pivoting the boom from a position generally parallel to the tube sheet to a position generally aligned with the manway, a carriage disposed to ride lengthwise along the boom, a tool operable on a tube, a tool holder disposed on the carriage, means for moving the carriage lengthwise along the boom and means disposed on the carriage for moving the tool holder along an axis parallel to the axis of a tube, whereby the apparatus will perform repair operations on the tubes.

BRIEF DESCRIPTION OF THE DRAWINGS

The objects and advantages of this invention will become more apparent from reading the following detail description in connection with the accompanying drawings, in which.

DESCRIPTION OF THE PREFERRED EMBODIMENT

Figure 1:
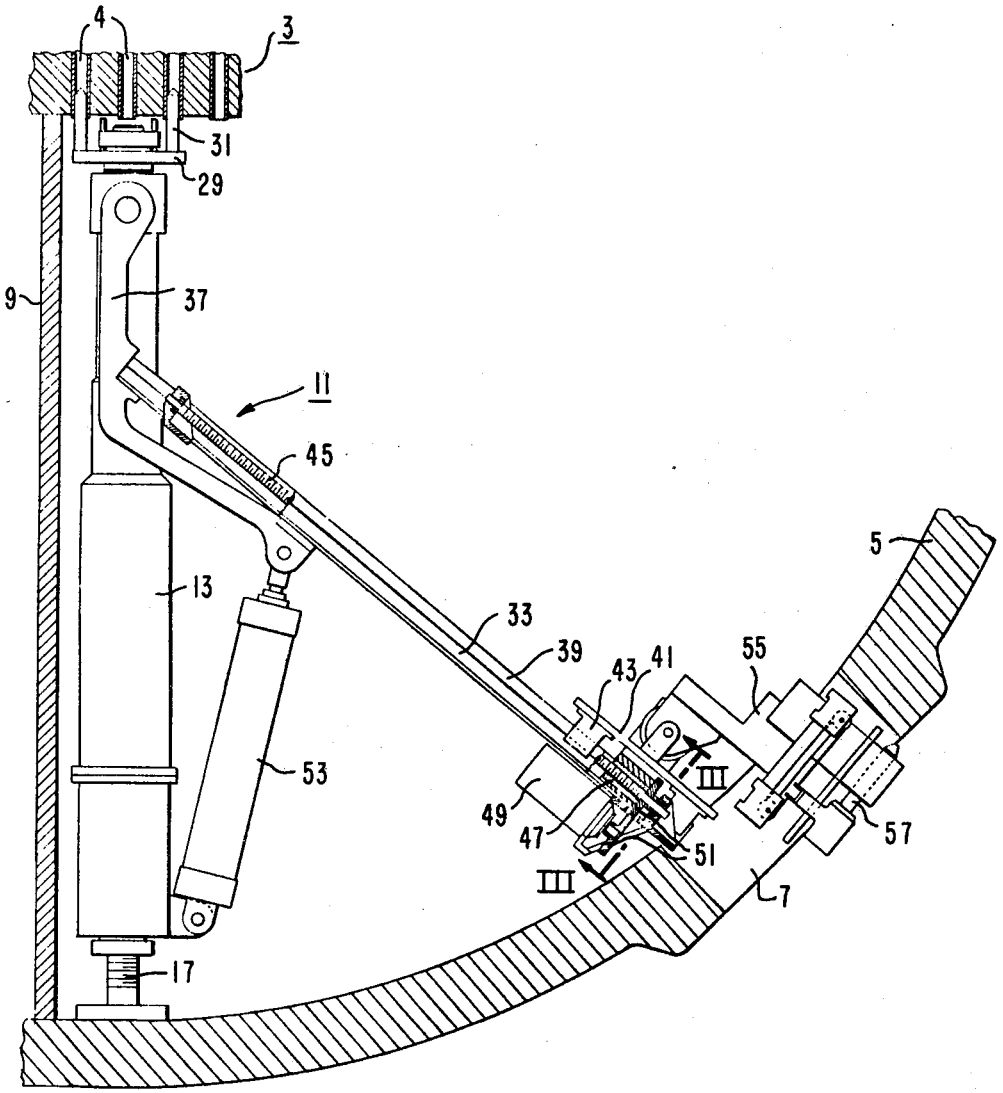
FIG. 1 is a partial sectional view of a channel head of a steam generator with apparatus for remotely repairing the tubes disposed therein.
Figure 2:
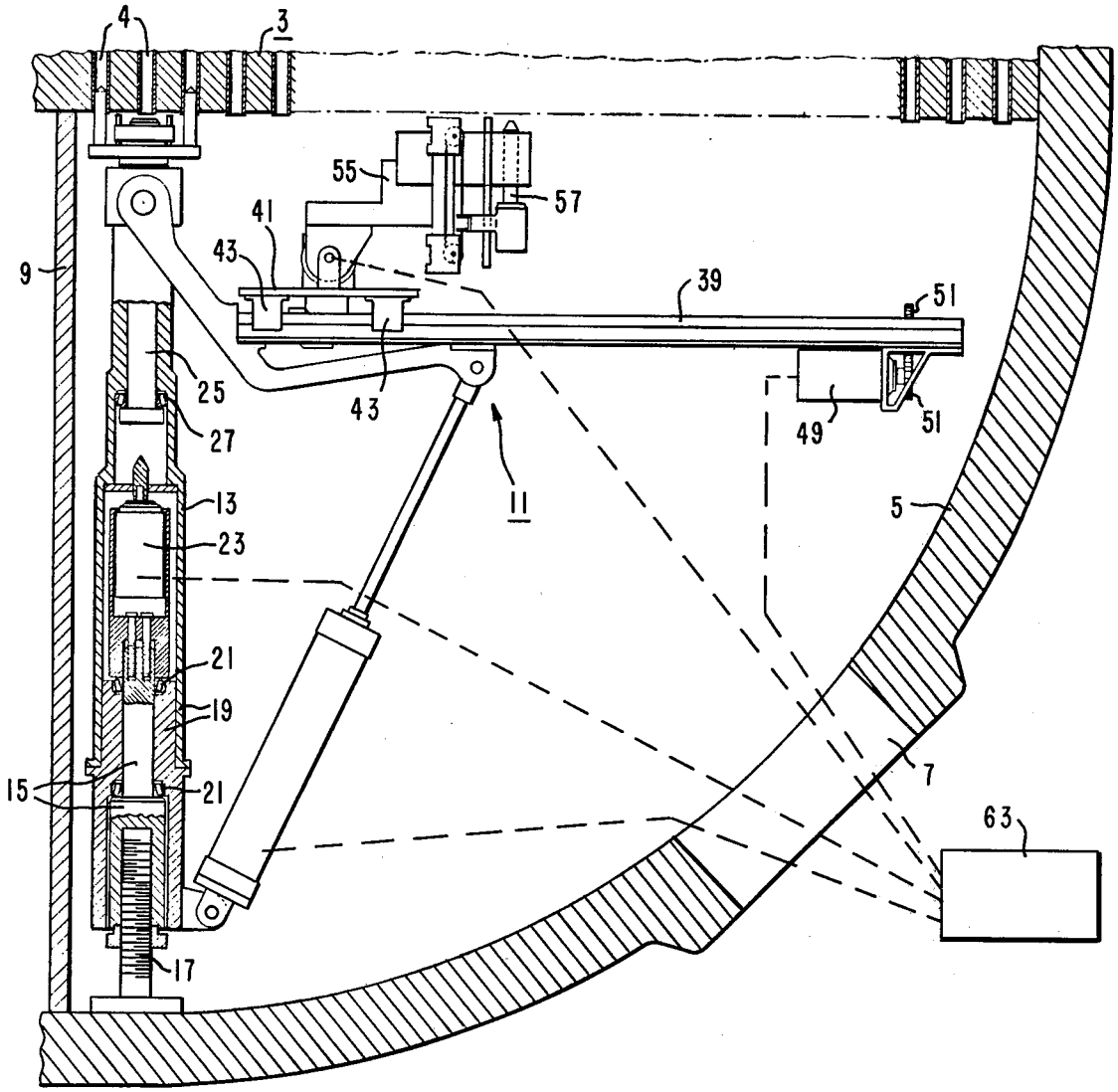
FIG. 2 is a partial sectional view of a channel head of a steam generator with the apparatus in a different position and shown in section.

Referring now to the drawings in detail and in particular to FIGS. 1 and 2 there is shown a portion of a channel head 1 of a nuclear steam generator 2 having a tube sheet 3 with a plurality of tubes 4 extending therefrom. The channel head 1 has generally spherical walls 5 and a manway 7 disposed within the walls to provide access to the interior thereof. A dividing plate 9 separates the head 1 into separate inlet and outlet compartments, only one of which is shown in the drawings.

Apparatus for remotely repairing and inspecting the tubes in the nuclear steam generator is shown disposed in the channel head 1 and generally indicated by the reference numeral 11. The apparatus 11 comprises a vertically oriented column 13 disposed generally perpendicular to the tube sheet 3 and adjacent the dividing plate 9.

The column 13, as shown in FIG. 2, comprises a plurality of shafts disposed about the central axis of the column 13. A first shaft 15 is affixed to the wall 5 of the channel head 1 and has a jack screw 17 disposed therein. A second shaft 19 fits over the first shaft 15 and is pivotally mounted thereto by a pair of tapered roller bearings 21. A reversible stepping drive motor, or other drive means, 23 is connected to the first and second shafts 15 and 19. When energized, the motor 23 rotates the second shaft in either direction with respect to the first shaft and stops at any position within its rotation. Within the motor are means for indicating the rotational position of the two shafts. A third shaft 25 is disposed to extend into the second shaft 19 and is rotatably connected thereto by a pair of tapered roller bearings 27, only one of which is shown. The third shaft is affixed to a plate 29 which has a plurality of rods 31 extending perpendicularly and upwardly therefrom. The rods 31 slide into the tubes 4 to position the column 13.

A boom 33 is pivotally mounted on the second shaft 19 of the column 13 by a pair of tapered roller bearings, which are not shown. The boom 33 has an arm 37 which is disposed at an oblique or obtuse angle with respect to the main portion thereof. The bearings are mounted in the distal end of the arm 37. The boom 33 has ways 39 axially aligned with the longitudinal axis of the boom 33.

A carriage 41 is slidably disposed on the boom having bearings 43 which slidably engage the ways 39. The ways 39 have a round cross section and the bearings 43 fit over more than half of the ways 39 thereby being retained thereon.

Figure 3:
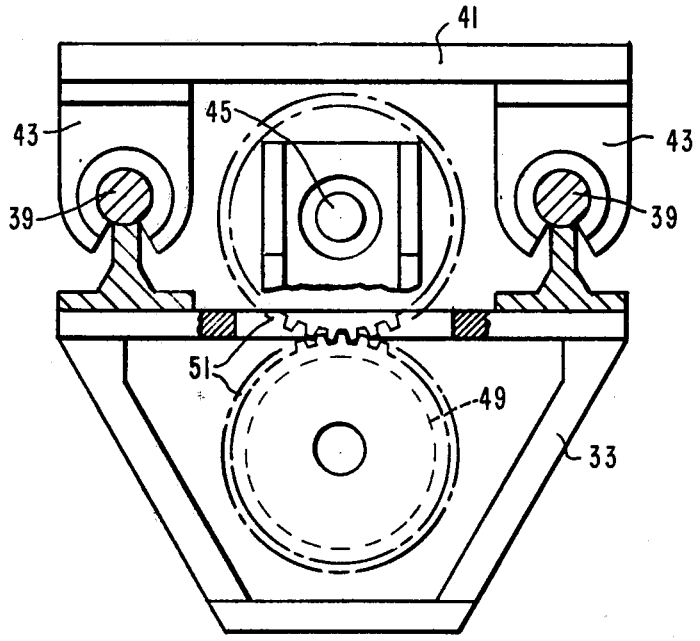
FIG. 3 is a sectional view taken on line III—III of FIG. 1.

As shown in FIG. 3, a screw 45 is disposed between the ways 39 so that its axis is parallel to the longitudinal axis of the boom 33. A nut 47 is affixed to the carriage 41 and threads of the nut 47 engage threads of the screw 45. A reversible electrical stepping motor 49 or other drive means is connected to the screw 45 by a pair of spur gears 51 or other drive means to rotate the screw 45 in either direction to move the carriage 41 back and forth longitudinally or lengthwise along the boom 33.

A hydraulic cylinder 53 is pivotally connected to the column 19 and to the boom 33. When the hydraulic cylinder 53 is energized it raises the boom 33 to a generally horizontal position generally parallel to the tube sheet 3 and when the hydraulic cylinder is deenergized the boom 33 is lowered to a position where it is aligned with the manway 7. The hydraulic cylinder may be a single acting cylinder and the weight of the boom, carriage, and other devices is sufficient to cause it to move to the lower position; or a double acting cylinder may be utilized.

A tool holder 55 is pivotally mounted on a carriage 41 to provide better access for replacing tools in the tube holder when the boom 33 is aligned with the manway 7. The tool holder 55 has a tool 57 attached thereto by a key and spring loaded pins not shown or other attaching means. This arrangement allows for quick removal and replacement of tools. The tool 57 shown in this embodiment is an insertion mechanism for inserting explosive plugs into the tubes 4. It being understood that this tool is exemplary and any tool which operates on a tube or tube sheet may be inserted into the tube holder to perform numerous repair operations on the tubes or tube sheet.

An on-the-line minicomputer 63 may be utilized to control the movement of the column, carriage, and tool holder so that repeated operations may be performed on the same tube with a minimum amount of operator intervention so as to minimize the amount of time an operator spends in the radioactive environment of the steam generator while performing repair operations on the tubes or tube sheet.

What is claimed is:

1. Apparatus for remotely repairing tubes disposed in a tube sheet in a channel head of a steam generator having a manway disposed in the head, said apparatus comprising a column rotatably disposed in said head generally perpendicular to said tube sheet;

a boom pivotally mounted on said column;

means for rotating said column and said boom therewith;

means for pivoting said boom from a position generally parallel to said tube sheet to a position generally aligned with said manway;

a carriage disposed to ride lengthwise along said boom;

a tool operative on a tube;

a tool holder disposed on said carriage;

means for moving said carriage lengthwise along said boom; and means disposed on said carriage for moving said tool along an axis parallel to the axis of the tube, whereby said apparatus will perform repair operations on said tubes.

2. The apparatus as set forth in claim 1, wherein the tube holder is pivotally mounted on said carriage to provide better access to the tube holder when it is adjacent the manway.

3. The apparatus as set forth in claim 1, wherein the longitudinal axis of the boom is offset with respect to the pivotal axis of the boom, whereby the distal end of the boom is close to the wall of the head when the boom is parallel to the tube sheet and also when the boom is adjacent the manway.

4. The apparatus as set forth in claim 1, wherein the boom has an arm forming an oblique angle with respect to the longitudinal axis of the boom and the pivotal axis of the boom is disposed in the distal end of the arm, whereby the distal end of the boom is close to the wall of the head when the boom is generally parallel to the tube sheet and when the boom is generally aligned with the manway.

5. The apparatus as set forth in claim 1, wherein the means for moving the carriage lengthwise along the boom comprises a screw rotatably disposed generally parallel to the longitudinal axis of the boom, a drive cooperatively associated with the screw so that the screw may be rotated in either direction and an internally threaded member affixed to the carriage, the screw and internally threaded member being disposed in a threaded engagement, whereby rotation of the screw moves the carriage lengthwise along the boom.

6. The apparatus as set forth in claim 5, wherein the means for moving the carriage lengthwise along the boom further comprises ways disposed on opposite sides of the boom parallel to the longitudinal axis of the boom and bearings affixed to the carriage and slidably disposed on the ways.

7. The apparatus as set forth in claim 1, wherein the column comprises a first shaft fastened to the head and a second shaft fastened to the boom, said shafts being axially aligned.

8. Apparatus as set forth in claim 7, wherein the means for rotating the column and the boom therewith comprises a drive disposed between the first and second shafts, whereby operation of the drive rotates the second shaft with respect to the first shaft.

9. Apparatus as set forth in claim 7, wherein the column comprises a third shaft axially aligned with the first and second shafts, the third shaft being affixed to the tube sheet and rotatably connected to the second shaft.

10. Apparatus as set forth in claim 1, wherein the means for pivoting the boom from a position generally parallel to the tube sheet to a position generally aligned with the manway comprises a hydraulic cylinder, the ends of which are pivotally connected to the column and to the boom.

* * * * *